United States Patent [19]

Coppola et al.

[11] 4,211,245

[45] Jul. 8, 1980

[54] HAIR-WAVING DEVICE

[75] Inventors: Aldo Coppola; Antonio Coppola, both of Milan, Italy

[73] Assignee: Coiffeurs i Coppola, di Aldo e Antonio Coppola, s.n.c., Milan, Italy

[21] Appl. No.: 948,741

[22] Filed: Oct. 5, 1978

[30] Foreign Application Priority Data

Oct. 7, 1977 [IT] Italy ..... 22442/77[U]

[51] Int. Cl.[3] ..... A45D 2/00

[52] U.S. Cl. ..... 132/40; 132/9; 132/41 R

[58] Field of Search ..... 132/40–44, 132/33.1, 5, 7, 9, 48

[56] References Cited

U.S. PATENT DOCUMENTS

| | | | |
|---|---|---|---|
| 1,488,005 | 3/1924 | Freeman | 132/41 R |
| 2,627,274 | 2/1953 | Schneiderman | 132/42 R |
| 2,783,763 | 3/1957 | King | 132/41 R |
| 3,186,415 | 6/1965 | Teopilian | 132/42 R |

*Primary Examiner*—G. E. McNeill

*Attorney, Agent, or Firm*—Morgan, Finnegan, Pine, Foley & Lee

[57] ABSTRACT

A hair-waving device is disclosed, which is composed of an axonic body (e.g. a cylinder or a cone) on the surface of which a helical groove is formed. The helical groove communicates with a straight short groove in an axial direction across which a hair-clamping strap is arranged removably. A helical clip comprised of a single helix coil serves for snappingly engaging the free end of the strand of hair concerned.

7 Claims, 3 Drawing Figures

Fig. 1
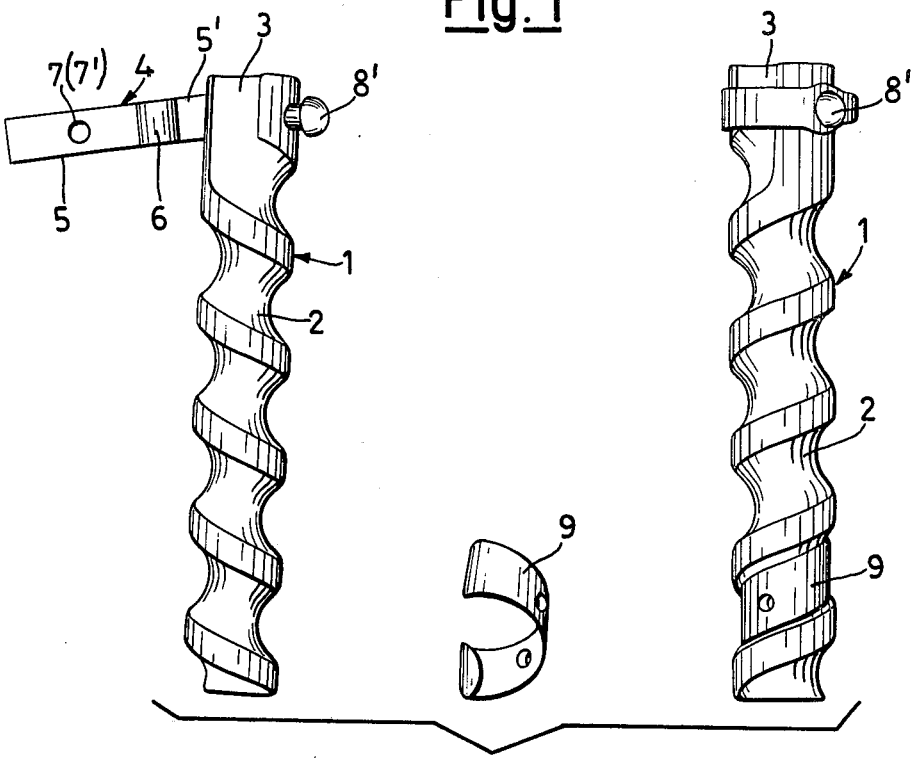
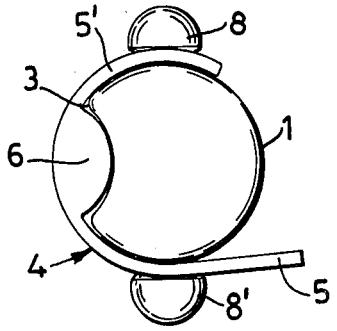
Fig. 2

HAIR-WAVING DEVICE

FIELD OF THE INVENTION

This invention relates to a hair-waving device, of the kind which is especially adapted for the so-called spiral waving: this hair-dressing style is different from the Marcel style since the strands or locks of hair are not wrapped tightly about a curler or roller so as to have superposed spiral, not helical, layers of hairs, but are wound along the spirals of a helix so as to take a spring-like configuration. This gives to the hairdressed subject an outlook different from the common waving in that a more springy and fluffy appearance is imparted to the dressed hair.

ABRIDGED SURVEY OF THE PRIOR ART

The art of making hair-dressing accessories is a rather crowded art: the following are the prior art disclosures which are known to the present applicants as the ones which come closer to the problem to be solved.

U.S. Pat. No. 866,778, Eldridge, which dates back to 1907 discloses a curling iron, thus not properly a hair-curler of the kind intended for permanent waving (not yet invented in those remote years), in which the hair is, so to speak, hot-pressed so as to impart thereto a curved imprint. More exactly, the patent in question speaks of "bends in the hair".

U.S. Pat. No. 1,895,653, Fisher, foreshadows the concept of the spiral hair waving and the concept of having helical members for winding the strands of hair thereinto and also the idea of having right-handed and left-handed helical spirals, but the construction of Fisher is clumsy, intricate, heavy and unpractical; in addition to that, the way in which the free end of the strand of hair concerned with each individual device of Fisher is to be tied or otherwise secured to the rod shank with cord or otherwise makes the use of the device still more clumsy. Furthermore, the clamping device for the proximal or scalp-end of the lock of hair is inconvenient, heavy and time-consuming in use.

U.S. Pat. No. 2,335,086, Ryan, appeared in times which are closer to the present ones and shows a sort of a rack for helically winding a lock of hair so as to impress a helical trend thereto, but the means for securing, rather than firmly clamping, the strand of hair ends are diamond-like perforations so that to pass a lock of hair through a couple of such devices is a nerve-racking, cumbersome and time-consuming operation, especially if one takes into account the fact that, for a usual hair-dressing operation, there are an average of 20–30 locks of hair to wind and thus as many hair-curlers to position. In addition, in Ryan, the asserted necessity of passing one coil over and one coil under the finger extending laterally from the curler, is but another complication which urgently requires to be disposed of. Abiding by the Ryan's disclosure, the task of impressing the wave to the hair would seem to have been entrusted more to the lateral finger than to the helical winding of the hair strands.

U.S. Pat. No. 2,374,860, Garrison, discloses a permanent wave accessory having a handle (thus it resembles more to a curling iron than to a curler proper which needs no support) and a slotted saucer-like appendage intended to clamp the hair strands prior to being helically twisted, and thereafter, as the drawings of Garrison would suggest. It is hardly conceivable that a person may tolerate the weight of a number of such devices on her head.

U.S. Pat. No. 2,627,274, Schneidemann, discloses on FIGS. 5–7 an embodiment of his invention in which a tapered rod with a helical groove is used, but the hair-clamping "mechanism", so to dub it, is so intricate that to wind the individual hair strands prior to "steaming" or "cold-waving" and to unwind them on completion of the waving stage are time-consuming operations which also present the hazard of tearing the hair.

U.S. Pat. No. 3,186,415, Teopilian, shows a hair curler with selectively engageable fastening means. This patent, which comes to times still closer to our present times, discloses a hair-curler of the "wrapping" or "curling" type since, apart from its intricate mechanical construction, it specifies, and this can be clearly seen in FIG. 1, that the hair curler, prior to clamping the hair-strand concerned, must be rotated between the fingers, that which means an axial rotation for carrying out a superposedly spiral wrapping motion.

U.S. Pat. No. 3,566,888, Bonarigo is quoted here since it is of the helical spiral type, but the function of the hair-curler of Bonarigo is rather that of clamping the hair strands between complementary crenellations formed on the edge of a spiralled ribbon rather than to impress a helical twist to such strands.

BACKGROUND AND OBJECTS OF THE INVENTION

The primary object of the present invention is to provide a hair-waving device which is simplicity itself from the constructional standpoint, it is easy and convenient to manipulate in the beauty-parlor everyday practice and which is economically acceptable.

Another object of the invention is to provide a hair-waving device having improved and simplified hair-clamping members which can rapidly and efficiently manipulated, a feature which is most important in the present days when time saving is a must.

Other features and objects and advantages of the present invention will become apparent as the present disclosure proceeds.

Broadly stated, according to this invention, there is provided:

A hair-waving device comprising, in combination:

(a) an axonic body having a proximal end and a distal end;

(b) an uninterrupted helical groove formed on the surface of said axonic body, starting from said distal end and terminated near said proximal end;

(c) a gutter-like groove arranged on the surface of the proximal end of said axonic body in axial direction and as an upward extension of said helical groove;

(d) two trunnion-like, diametrically opposite knob-topped pins, each on either side of said gutter-like groove;

(e) a strap of resiliently yielding material having end holes for inserting the knob-like ends of sad trunnion-like pins therethrough, and a ridge matching the outline of said gutter-like groove for clamping the proximal end of a lock of hair therebetween, and (f) a helical clip of a snappingly resilient material and adapted to engage the distal end of said axonic body for clamping the free end of said lock of hair, the latter having been helically wound in the helical groove of said axonic body.

To explain the present applicants' terminology, in the specification and claims hereof, the term "proximal" means the end which is near the scalp, or scalp shank of a strand of hair on the hair-waving device, the "distal, or free,end" is the end away of the proximal end, and "axonic body" is generally speaking any geometrical body having a longitudinal central axis, such as a cylinder, a cone, or a frustum of a cone and the like.

When a conical taper is preferred for special reasons, it is generally intended that the conical taper will run from the proximal to the distal end of the axonic body.

The material for the device of the invention is, preferably but not exclusively, a plastics material of the kind resisting heat and chemicals of the temperature range and type as commonly used in hair-waving.

It is important to note that the direction of the helix for the helical grooves must be twofold, in the sense that a set of devices must have a right-hand helix and another set of the two must have a left-hand helical winding.

It is known, e.g. from Fisher, cited above, that helices of opposite winding directions are used one for one side of the face of the wearer, and the other for the other side of the face.

For this reason, the invention is also concerned with a hair-waving set or kit which contains an equal number, or so, of right-handed helical members and left-handed helical members, inasmuch as it would have no sense to make the elements all with the same helical winding direction.

BRIEF DESCRIPTION OF THE DRAWINGS

The invention will be better understood as to its features and advantages, by viewing the accompanying drawings which depict a preferred embodiment of the invention.

In the drawings:

FIG. 1 is an overall view in front elevation of a hair-waving set according to this invention, the set comprising a right-handed element and a left-handed element; details of the hair-clamping members are also shown in the FIGURE.

FIG. 2 is a top plan view of a device and shows the clamping element for the hair on the scalp side thereof.

DESCRIPTION OF THE PREFERRED EMBODIMENT

Figure 3:
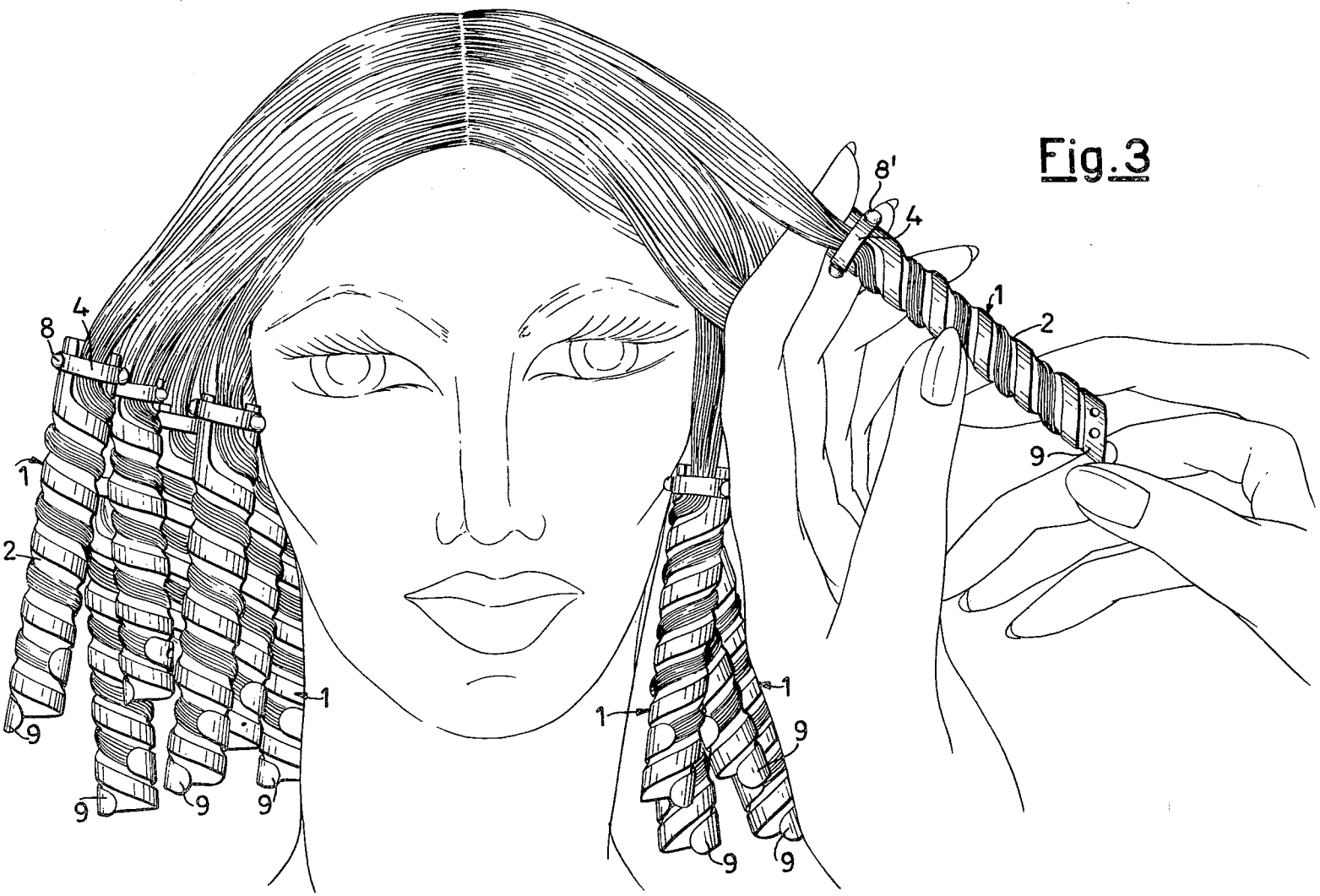
FIG. 3 is a picture showing a plurality of devices in their positions of actual use.

Having now reference to the accompanying drawings and especially, at the outset, to FIGS. 1 and 2 thereof, it will be seen that the device of the invention comprises an axonic body, 1, which is, in the example shown , cylindrical, but could be tapered conically, if so desired. The body 1 has a proximal, or scalp, end which is shown at top in all drawings, and a distal or free end which is shown at the bottom in all of the drawings. A helical groove, 2, is formed on the side surface of 1 and is roughly semicircular in cross-section: it is not necessary to be bound to any particular outline, it being enough that the groove is capable of receiving with a loose fit a strand or wetted hair. The helical groove 2 starts from the bottom end of the device and is terminated in the vicinity (e.g. ¾ of an inch) of the proximal or scalp end of the device.

The helical groove scalp end communicates with a gutter-like groove 3 (this can have the same cross-sectional outline of the helical groove, but this is by no means compulsory) which goes on to the top of the body 1 along an axial direction. Across the groove 3 there is strap 4 of a resilient yielding stretchable material, such as rubber or another elastomer. The strap 4 has two side wings, 5,5' and a central ridge 6, which matches the bottom of the straight gutter-like groove 3: the wings 5,5' have holes 7, 7' for engaging two trunnion-like, knob-topped pins, 8, 8', placed on the ends of a diameter of 1 which is perpendicular to the diametrical plane which halves the gutter-like groove 3, as can be seen in the drawings. When the strap 4 is placed in position, as it it obvious, a strand of hair (the scalp end) inserted between the strap 4 and the groove 3 is held so firmly in position that the device can freely hang downwards, that which can best be seen in FIG. 3. A helical clip 9 is made of a snappingly resilient material, such as resilient nylon and like materials, and serves to clamp the free or distal end of the lock of hair. The pitch of the helix of the clip 9 is the same as that of the helical groove 2 and its length is generally not longer than one spiral or coil of the helix, which is more than adequate and convenient in use. If desired, a strip of paper can be inserted between the clip and the hair strand (see FIG. 3) to improve friction, but this is by no means an essential measure.

It is to be noted that in FIG. 1 one strap 4 is shown disengaged at one end, for the left-hand device, and is shown closed at both ends for the right-hand device. The top view of FIG. 2 makes the central hair-clamping ridge 6, of the strap 8 clearly visible.

The pictorial view of FIG. 3 shows a plurality of devices according to the invention in use and the principal component parts of them have been identified with their attendant reference numerals.

While the invention has been shown and described in connection with a preferred embodiment thereof, be it understood that modifications and changes can be introduced therein as to the materials of which the component parts of the device may be made and as to the structure of the individual component parts without departing from the spirit and scope of same invention, as defined in and by the claims appended hereto.

We claim:

1. A hair-waving device comprising, in combination:
   (a) an axonic body having a proximal end and a distal end;
   (b) an uninterrupted helical groove formed on the surface of said axonic body, starting from said distal end and terminating near said proximal end;
   (c) a gutter-like groove arranged on the surface of the proximal end of said axonic body in an axial direction and as an upward extension of said helical groove;
   (d) two trunnion-like, diametrically opposite knob-topped pins, each on either side of said gutter-like groove and extending outwardly from the axonic body;
   (e) a strap of resiliently yielding material having end holes for inserting the knob-like ends of said trunnion-like pins therethrough, and a ridge matching the outline of said gutter-like groove for clamping the proximal end of a lock of hair therebetween, and,
   (f) a short helical clip of a snappingly resilient material having a configuration substantially corresponding to the helical groove in the axonic body and adapted to engage the distal end of said axonic body for clamping the free end of said lock of hair, the latter having been helically wound in the helical groove of said axonic body.

2. Hair-waving device according to claim 1, wherein said axonic body is cylindrical and comprises a stiff plastic material.

3. Hair-waving device according to claim 1, wherein said axonic body is conically tapered from its proximal to its distal end.

4. Hair-waving device according to claim 1, wherein said uninterrupted helical groove is a right-handed helix.

5. Hair-waving device according to claim 1, wherein said uninterrupted helical groove is a left-handed helix.

6. Hair-waving device according to claim 1, wherein said strap is made of an elastomeric material.

7. Hair-waving device according to claim 1, wherein said helical clip is a single helix-turn long and comprises a resilient polyomide plastic material.

* * * * *